US007978209B2

(12) United States Patent
Fukui

(10) Patent No.: US 7,978,209 B2
(45) Date of Patent: Jul. 12, 2011

(54) IMAGE FORMING APPARATUS, IMAGE FORMING METHOD AND IMAGE FORMING PROGRAM

(75) Inventor: Yasuhiro Fukui, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 788 days.

(21) Appl. No.: 12/014,308

(22) Filed: Jan. 15, 2008

(65) Prior Publication Data

US 2008/0170252 A1 Jul. 17, 2008

(30) Foreign Application Priority Data

Jan. 15, 2007 (JP) ..... 2007-005588

(51) Int. Cl.
*G09G 5/00* (2006.01)

(52) U.S. Cl. ..... 345/635

(58) Field of Classification Search ..... 345/629, 345/1.3, 635
See application file for complete search history.

(56) References Cited

U.S. PATENT DOCUMENTS 5,406,389 A 4/1995 Hasegawa et al.
5,854,850 A * 12/1998 Linford et al. ..... 382/128
6,259,457 B1 * 7/2001 Davies et al. ..... 345/629
6,972,774 B2 * 12/2005 Eguchi ..... 345/629
2002/0101992 A1 8/2002 Laaksonen
2005/0225669 A1 * 10/2005 Tsai et al. ..... 348/383

FOREIGN PATENT DOCUMENTS

CN 1874407 A 12/2006
JP 6-19613 A 1/1994
JP 2000-324333 A 11/2000
JP 2002354226 A 12/2002
JP 2004-239998 A 8/2004

* cited by examiner

*Primary Examiner* — Ryan R Yang
(74) *Attorney, Agent, or Firm* — Westerman, Hattori, Daniels & Adrian, LLP

(57) ABSTRACT

An image displayer 7 displays image data correlated to a plurality of block regions. An image selector 9 receives a selection of a displayed arbitrary block region and a selection of modifying an image mode of the image data corresponding to the selected block region. An image processor 11 executes processing of modifying the image data corresponding to the selected block region, to the selected image mode and displaying this modified image data in the image displayer 7. When modified image data displayed in the image displayer 7 is selected and determined, an image replacement section (image selector) 9 replaces image data portion before modification, with the modified image data whose image mode is modified. As a result, since the image data is previewed and the image mode is modified before printing, a desired expected print mode can be obtained.

19 Claims, 4 Drawing Sheets

IMAGE FORMING APPARATUS, IMAGE FORMING METHOD AND IMAGE FORMING PROGRAM

BACKGROUND ART

1. Field of the Invention

The present invention relates to an image forming apparatus, an image forming method and an image forming program, and relates to the image forming apparatus, the image forming method, and the image forming program suitably used in a copying machine or a multi function peripheral mounted with a preview function capable of displaying an image before forming the image.

2. Related Art

In recent years, the copying machine and the multi function peripheral have a function of displaying and confirming a preview of image data before printing and thereafter perform print processing, thereby making it possible to prevent a print error such as that a printed mode is not an expected image.

For example, Japanese Patent Laid Open No. 2000-324333 (Patent document 1) provides such a kind of image processing apparatus.

The patent document 1 has a first region determination step of determining an extraction region for extracting the image of a first manuscript; a first reading step of reading the image of the extraction region under an external instruction; a first display step of displaying an extracted image read by this first reading step; a second determination step of determining a fitting region in a second manuscript into which the extracted image is fitted; a second reading step of reading the image of the second manuscript under the external instruction; and a second display step of displaying a synthetic result obtained by fitting the extracted image into the second manuscript.

With this structure, a synthetic image before printing can be confirmed with good efficiency and the synthetic image is adjusted, thus making it possible to reduce error copying as much as possible.

However, according to the aforementioned patent document 1, an input/output device such as a so-called digitizer or a coordinate input pen is used in determining extraction of the first region desired to be processed and in determining the fitting region in the second manuscript into which the extracted first region is fitted, thus involving a problem such as making a structure complicated, easily inviting an increase of cost, and making an operation procedure complicated.

SUMMARY OF THE INVENTION

In view of the above-described problem, the present invention is provided, and an object of the present invention is to provide an image forming apparatus, an image forming method, and an image forming program capable of previewing an image before printing, modifying a mode, and obtaining an expected print mode, with a simple structure.

In order to solve such a problem, the present invention takes several structures as follows.

A first structure of the present invention provides the image forming apparatus including an image displayer that displays image data correlated to a plurality of block regions; an image selector that receives a selection of an arbitrary block region in a displayed block regions and a selection of modifying an image mode of the image data corresponding to the selected block region; an image processor that applies modification processing to the image data corresponding to the selected block region so as to be modified to the selected image mode, and displays the modified image data on the image displayer; and an image replacement section that replaces an image data portion before modification, with modified image data when this modified image data displayed on the image displayer is selected and confirmed.

Another structure of the present invention provides the image forming apparatus, wherein the aforementioned displayer magnifies and displays the selected block region, and the aforementioned image selector receives a selection of modifying the image mode of the image data corresponding to the block region thus magnified and displayed.

Another structure of the present invention provides the image forming apparatus, wherein the aforementioned image selector is formed so that the selection of color modification can be received as the selection of modifying this image mode, and the aforementioned image processor applies color modification processing to the image data.

Another structure of the present invention provides the image forming apparatus, wherein the aforementioned image selector is formed so that the selection of modifying a size can be received as the selection of modifying this image mode, and the aforementioned image processor applies size modification processing to the image data.

Another structure of the present invention provides the image forming apparatus, wherein based on a re-selection of the image mode by the image selector directed to the displayed modified image data, the aforementioned image processor applies processing of re-modifying this image mode, to the modified image data.

Another structure of the present invention provides the image forming apparatus, wherein the aforementioned image selector also serves as the image displayer.

Another structure of the present invention provides the image forming apparatus, wherein by the aforementioned image processor, a modification mode of the image data corresponding to a boundary block in the selected block region is modified to a mode between an image data mode corresponding to other selected block region and an image data mode corresponding to a non-selected block region.

Still another structure of the present invention provides an image forming method, including:

image display processing for displaying image data correlated to a plurality of block regions;

image selection processing for selecting an arbitrary block region in the displayed block regions and selecting a modification of the image mode of the image data corresponding to the selected block region;

image modification processing for executing processing of modifying the image data corresponding to the selected block region to the selected image mode and displaying this modified image data;

selection determination processing for selecting and determining the displayed modified image data; and image replacement processing for replacing an image data portion before modification, with the image data whose image mode is modified, when the modified image data is determined by this selection determination processing.

Still another structure of the present invention provides the image forming method, wherein in the aforementioned image display processing, the selected block region is magnified and displayed, and in the aforementioned image selection processing, it is possible to receive the selection of modifying the image mode for the image data corresponding to the magnified and displayed block region.

Still another structure of the present invention provides the image forming method, wherein in the aforementioned image selection processing, the selection of color modification is received as a selection of modifying the image mode, and in the aforementioned image processing, the processing of modifying the color is applied to the image data.

Still another structure of the present invention provides the image forming method, wherein in the aforementioned image selection processing, the selection of modifying a size is received as the selection of modifying the image mode, and in the aforementioned image processing, the processing of modifying the size is applied to the image data.

Still another structure of the present invention provides the image forming method, wherein in the aforementioned image modification processing, based on the re-selection of the image mode by the image selector for the displayed modified image data, the processing of re-modifying the image mode is applied to the modified image data.

Still another structure of the present invention provides the image forming method, wherein in the aforementioned image processing, the modification mode of the image data corresponding to a boundary block in the selected block region, is modified to a mode between an image data mode corresponding to other selected block region and an image data mode corresponding to a non-selected block region.

Still another structure of the present invention provides an image forming program, to cause an image processing computer for modifying and processing the image mode of the image data correlated to a plurality of block regions, to apply processing to the image data such as:

image display processing for displaying this image data correlated to the plurality of block regions;

image selection processing for receiving a selection of an arbitrary block region in the displayed block regions and a selection of modifying the image mode of the image data corresponding to the selected block region; and image processing for applying processing to the image data corresponding to the selected block region so as to be modified to the selected image mode, and displaying the modified image data; and image replacement processing for replacing the image data portion before modification, with this image data whose image mode is modified, when the displayed modified image data is determined and selected.

Another structure of the present invention provides the image forming program, wherein the aforementioned image display processing magnifies and displays the selected block region, and the aforementioned image selection processing receives the selection of modifying the image mode of the image data corresponding to the magnified and displayed block region.

Another structure of the present invention provides the image forming program, wherein the aforementioned image selection processing receives the selection of color modification as a selection of modifying the image mode, and the aforementioned image processing applies color modification processing to this image data.

Another structure of the present invention provides the image forming program, wherein the aforementioned image selection processing receives the selection of a size modification as the selection of modifying the image mode, and the aforementioned image processing applies size modification processing to the image data.

Another structure of the present invention provides the image forming program, wherein based on the re-selection of the image mode by the image selector for the displayed modified image data, re-modification processing of the image mode is applied to the modified image data.

Another structure of the present invention provides the image forming program, wherein the aforementioned image processing executes the processing of modifying the modification mode of the image data corresponding to the boundary block in the selected block region, to a mode between the image data mode corresponding to other selected block region and the image data mode corresponding to the non-selected block region.

In the image forming apparatus, the image forming method, and the image forming program according to the present invention, the image data is displayed correlated to a plurality of block regions, the selection of an arbitrary block region and the selection of modifying the image mode of the image data corresponding to the selected block region are received, the image data corresponding to the selected block region is modified to the selected image mode and displayed, and when this modified image data is determined and selected, the image data portion before modification is replaced with this modified image data whose image mode is modified. Therefore, printing is possible after previewing the image and modifying the mode before printing, thus making it easy to obtain an expected print mode, with a simple structure.

According to the present invention, the selected block region is magnified and displayed and the selection of modifying the image mode of the image data corresponding to the block region thus magnified and displayed, is received. Therefore, the image in the selected block region is magnified and it is significantly easy to confirm a magnified image.

According to the present invention, the selection of the color modification is received as the selection of modifying the image mode and color modification processing is performed. Therefore, the printing is possible after modifying a color mode of the image in the selected block region, making preview, and confirming the color-modified image.

According to the present invention, the selection of modifying the size is received as the selection of modifying the image mode, and the size is modified. Therefore, the printing is possible after modifying large and small modes of the image in the selected block region, making preview, and confirming this image.

According to the present invention, the re-modification processing of the image mode is performed based on the re-selection by this image selection processing. Therefore, the selection of modifying and processing of modifying this image mode can be performed a plurality of times, thus making it further easy to obtain an expected print mode.

According to the present invention, the modification mode of the image data corresponding to the boundary block in the selected block region is modified to an intermediate mode of the circumferential block region. Therefore, a difference between the image that has undergone modification processing and the circumferential image can be suppressed to be small.

DETAILED DESCRIPTION OF THE INVENTION

Preferred embodiments of an image forming apparatus, an image forming method and an image forming program according to the present invention will be explained hereunder, with reference to the drawings. In addition, the image forming method and the image forming program will be explained in a process of explaining the image forming apparatus.

Figure 1:
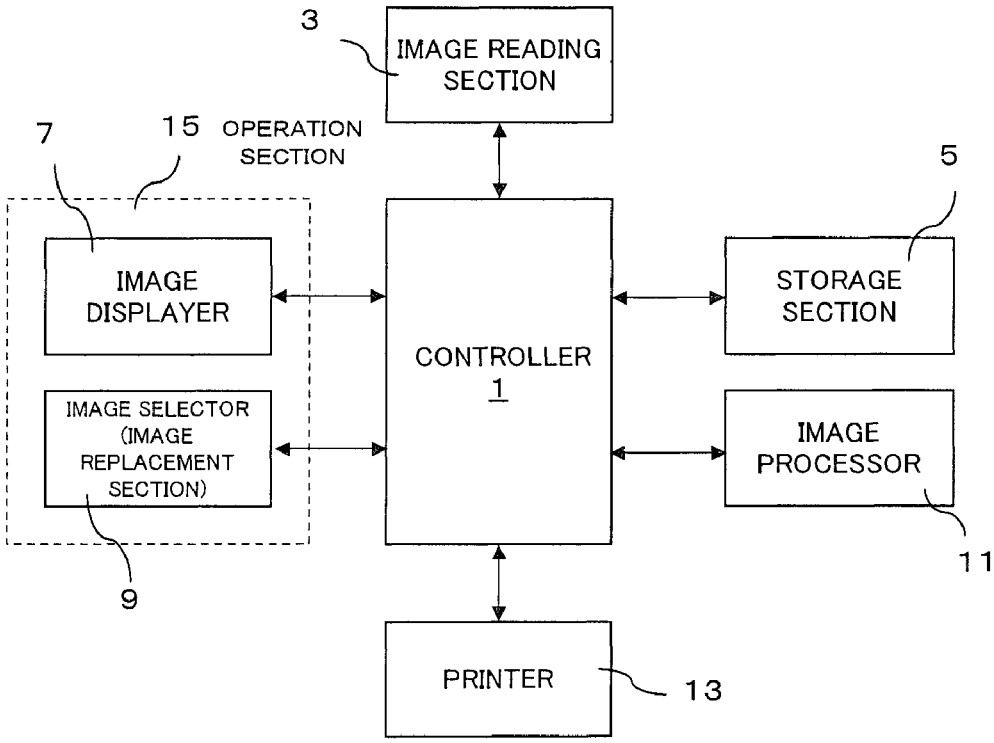
FIG. 1 is a schematic block diagram of an embodiment of an image forming apparatus according to the present invention.

FIG. 1 is a schematic block diagram showing an embodiment of the image forming apparatus according to the present invention.

In FIG. 1, the image forming apparatus of the present invention is, for example, a copying machine or a multi function peripheral, having an image reading section 3, a storage section 5, an image displayer 7, an image selector 9, an image processor 11, and a printer 13, with a controller 1 as a center. A function of the controller 1 will be described later.

Under a control of the controller 1, the image reading section 3 serves as a publicly-known scanner, etc, that optically reads an image from a printed manuscript of a plurality of pages, applies filter processing, magnification processing, and gradation processing etc, to this image, and electronically generates image data, so that the generated image data is sequentially stored in the storage section 5, for every page of the manuscript.

In some cases, the image reading section 3 has an automatic paper feeding mechanism for automatically feeding a paper and reading the manuscript of a plurality of pages. However, this function is publicly-known and therefore figures therefore and explanation therefore are omitted.

Under the control of the controller 1, the storage section 5 serves as a hard disc (HDD), for example, in which the image data from the image reading section 3 and the image displayer 7 and modified image data and printed image data from the image processor 11 and so forth are writably readably stored.

Figure 2:
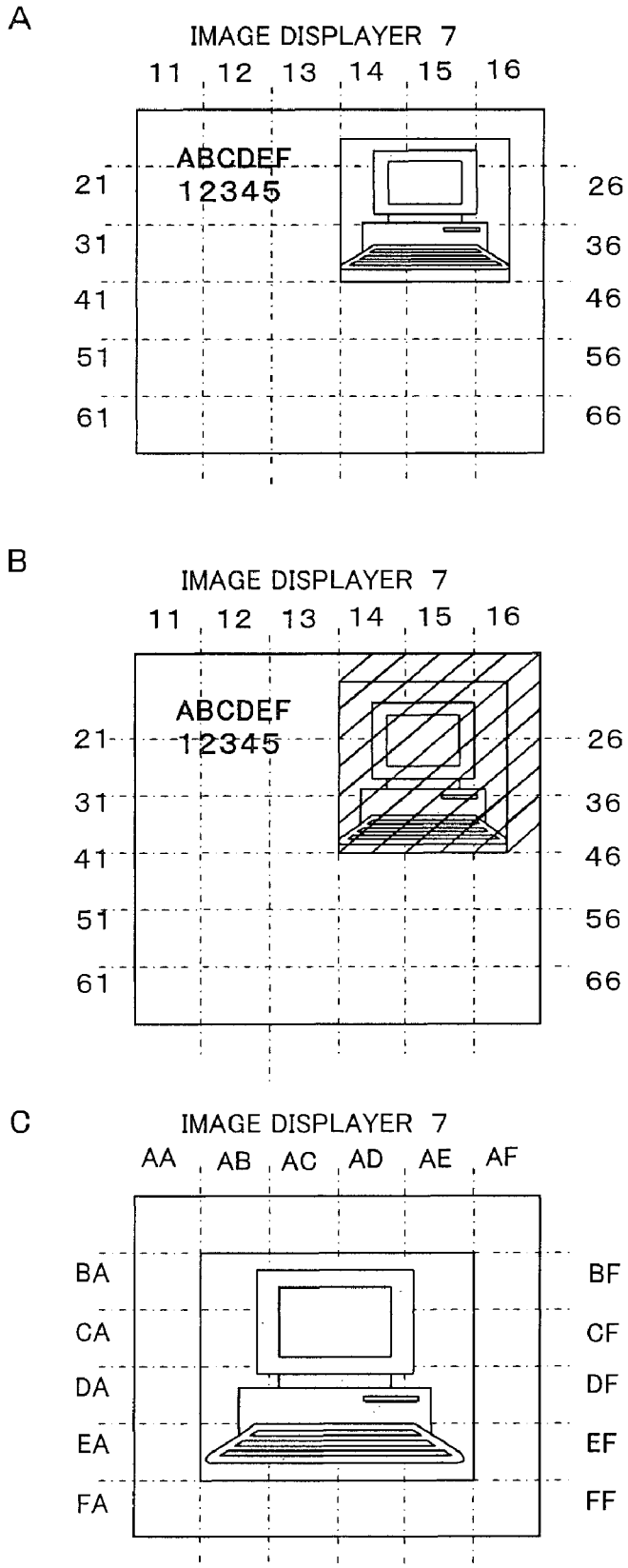
FIG. 2 is a view showing an example of a display state in an image displayer of FIG. 1.

The image displayer 7 serves as a touch panel switch type liquid crystal display, etc, disposed in a body case (not shown) of the image forming apparatus, and has a function of displaying the aforementioned image data as shown in FIG. 2A, for example, under the control of the controller 1.

The displayed image is displayed, so as to display a first page of the image data from the storage section 5, under the control of the controller 1. However, pages of before/behind are switched and displayed by a selection instruction signal from the image selector 9 as will be described later.

As shown in FIG. 2A, the image displayer 7 has a function of displaying the image data from the storage section 5, so as to be correlated to a plurality of block regions.

In FIG. 2A, designation marks 11 to 16, 21 to 26, 31 to 36, 41 to 46, 51 to 56, and 61 to 66 show virtual block regions, with a display surface of the image displayer 7 divided at equal intervals in the vertical and horizontal directions. Displayed image data of one page belongs to any one of thirty-six block regions 11 to 66.

When any one of the block regions 11 to 66 are touched, as will be described later, the image displayer 7 is controlled to be changed so that brightness of the touched block regions 11 to 66 are slightly lowered, and a selection signal, which shows that these block regions 11 to 66 are selected, is outputted to the controller 1. Namely, the image displayer 7 substantially serves as the image selection section 9.

For example, as shown in FIG. 2A, when the image data of one page has a photograph image at a position corresponding to block regions 14, 15, 16, 24, 25, 26, 34, 35, 36, these block regions 14 to 36 are selected by touching these block regions (photograph image regions) 14 to 36, and the brightness of these block regions is slightly lowered as shown in FIG. 2B.

Under the control of the controller 1 based on the selection signal of the image selector 9, the image displayer 7 has a function of displaying in the same screen subdivisions (magnification display) of the image data corresponding to the block regions 14 to 36 shown in FIG. 2B, so as to be correlated to the plurality of block regions as shown in FIG. 2C. In FIG. 2C, for the convenience of explanation, subdivided regions of the block regions 11 to 66 shown in FIG. 2A and FIG. 2B are shown by block regions AA to FF.

Thus, the display surface of the image displayer 7 is divided into a plurality of block regions AA to FF, the aforementioned photograph image regions in the display surface correspond to individual block regions AA to FF. In addition, since the photograph image region is magnified, the boundary between the photograph image region and an outer periphery of this photograph image region is easily made to coincide with the boundary of the adjacent block regions AA to FF or approach thereto.

Therefore, for example, even if not using a digitizer or a coordinate input pen, by touching to designate block regions BB-BE, CB-CE, DB-DE, EB-EE in FIG. 2C, only the necessary photograph image region can be easily designated.

The image displayer 7 also has a function of displaying the operation of the image processing apparatus and displaying others. However, this function is not an essential part of the present invention, and therefore the explanation therefore and the figures therefore are omitted.

Figure 3:
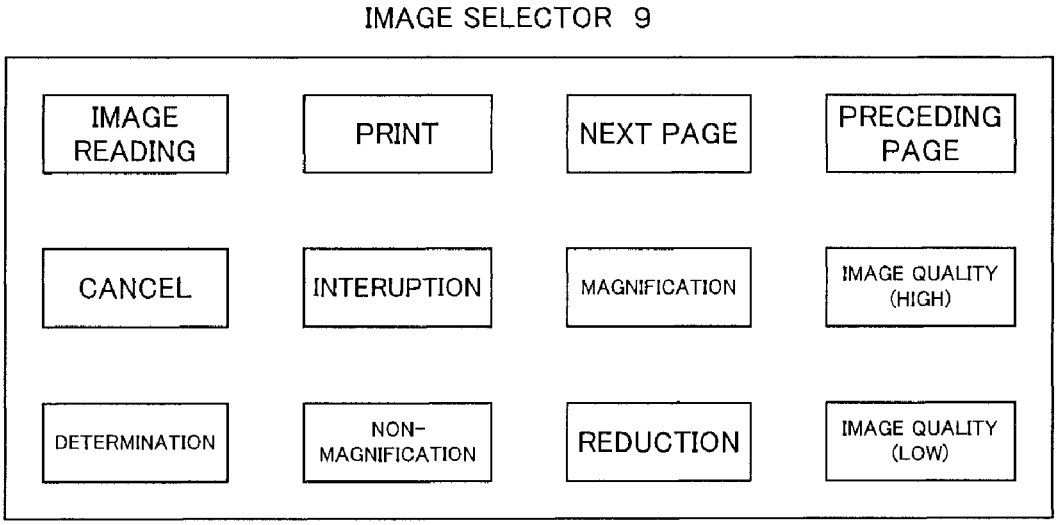
FIG. 3 is a view showing the example of a selected image in an image selector of FIG. 1.

The image selector 9, for example, serves as a touch panel switch type liquid crystal display, etc, disposed continuously to or near to the liquid crystal display as the image displayer 7, and the operation of the image selector 9 is controlled by the controller 1. The image selector 9 has, for example, as shown in FIG. 3, image region keys such as "image reading" key, "cancel" key, "determination" key, "print" key, "interruption" key, "un-magnification" key, "magnification" key, "reduction" key, "next page" key, "preceding page" key, "image quality (high)" key, and "image quality (low)" key.

When the individual image region key is touched, the image selector 9 receives the selection, etc, of the function allotted to the image region key, and outputs to the controller 1 an instruction signal for instructing the displayed selected function.

Note that an operation section 15 is formed by these image displayer 7 and image selector 9.

When the selection of the "determination" key for the image data displayed on the image displayer 7 is received, the image selector 9 has a function as an image replacement section that controls to replace an original image data portion before modification, with modified image data whose image mode is modified, as will be described later, via the controller 1, and stores this replaced image data in the storage section 5.

Under the control of the controller 1, based on the aforementioned designation signal, the image processor 11 has a function of modifying the image data corresponding to the selected block region in the image data stored in the storage section 5, to the selected image mode, and outputting this modified image data to the image displayer 7 as described above.

Namely, the image processor 11 has a function of applying magnification processing to the image data corresponding to the block regions 14 to 36 of FIG. 2B selected by the image selector 9 when the selection of the modification mode in the image selector 9 shows the "magnification" key, and as shown in FIG. 2C, the image processor 11 has a function of displaying the modified image data in the block regions AA to FF of the image displayer 7.

Although not shown, when the "un-magnification" key is pressed as the selection of the modification mode by the image selector 9, the image processor 11 has a function of applying un-magnification processing to the image data selected by the image selector 9, and when the "reduction" key is pressed, applying reduction processing to the image data, and when the "image quality (high)" key and the "image quality (low)" key are pressed, modifying the image quality to be high or low and displaying the modified image data.

When the "print" key, the "next page" key, and the "preceding page" key are pressed as the modification selection by the image selector 9, the image processor 11 has a function of executing such a processing literally shown by these keys.

When the "print" key is pressed by the image selector 9, the image processor 11 has a function of reading from the storage section 5 the image data including the aforementioned modified image data and developing this read image data to print image data, so that this print image data is outputted to the printer 13 via the controller 1.

In the image displayer 7, in accordance with the number of the selected block regions in the block regions 11 to 66, the image data corresponding to these block regions is magnified and displayed in the block regions AA to FF. However, in the image processor 11, the print image data corresponding to these block regions 14 to 36 is prepared. Namely, the magnification display of FIG. 2C is used only for the display.

Note that the modification mode of the image of the block regions 14 to 36 (AA to FF) is set in magnification or reduction, and when the image data is processed and displayed so as to be incorporated in the selected block regions 14 to 36, the image data is partially discarded or a blank is added to the image data.

Under the control of the controller 1, the printer 13 has a function as a color or monochromatic print engine, for forming an electrostatic image from the print image data by laser beams, executing toner development processing by this electrostatic latent image, transferring and toner-fixing a toner development to a carried print paper, and then ejecting this print paper.

The controller 1 is formed by having a CPU constituting a main essential part of a control operating function and an ROM storing an operation software of this CPU, and controls the image reading section 3, the storage section 5, the image displayer 7, the image selector 9, the image processor 11, and the printer 13, and functions as a part of these image displayer 7, image selector 9, image processor 11, and printer 13.

Namely, the controller 1 has a function of controlling the image data corresponding to the selected block regions 14 to 36 in the image data displayed on the image displayer 7, to be magnified and displayed in the image displayer 7, and when the image data is selected and determined, the controller 1 has a function of sending this selected image data to the image processor 11 and controlling the modified image data whose mode is modified, to be displayed in the image displayer 7, and has a function of controlling the printed image data developed and prepared by the image processor 11 to be outputted to the printer 13.

Next, an outline of the operation of the image processing apparatus according to the present invention will be explained, with reference to a flowchart of FIG. 4.

Figure 4:
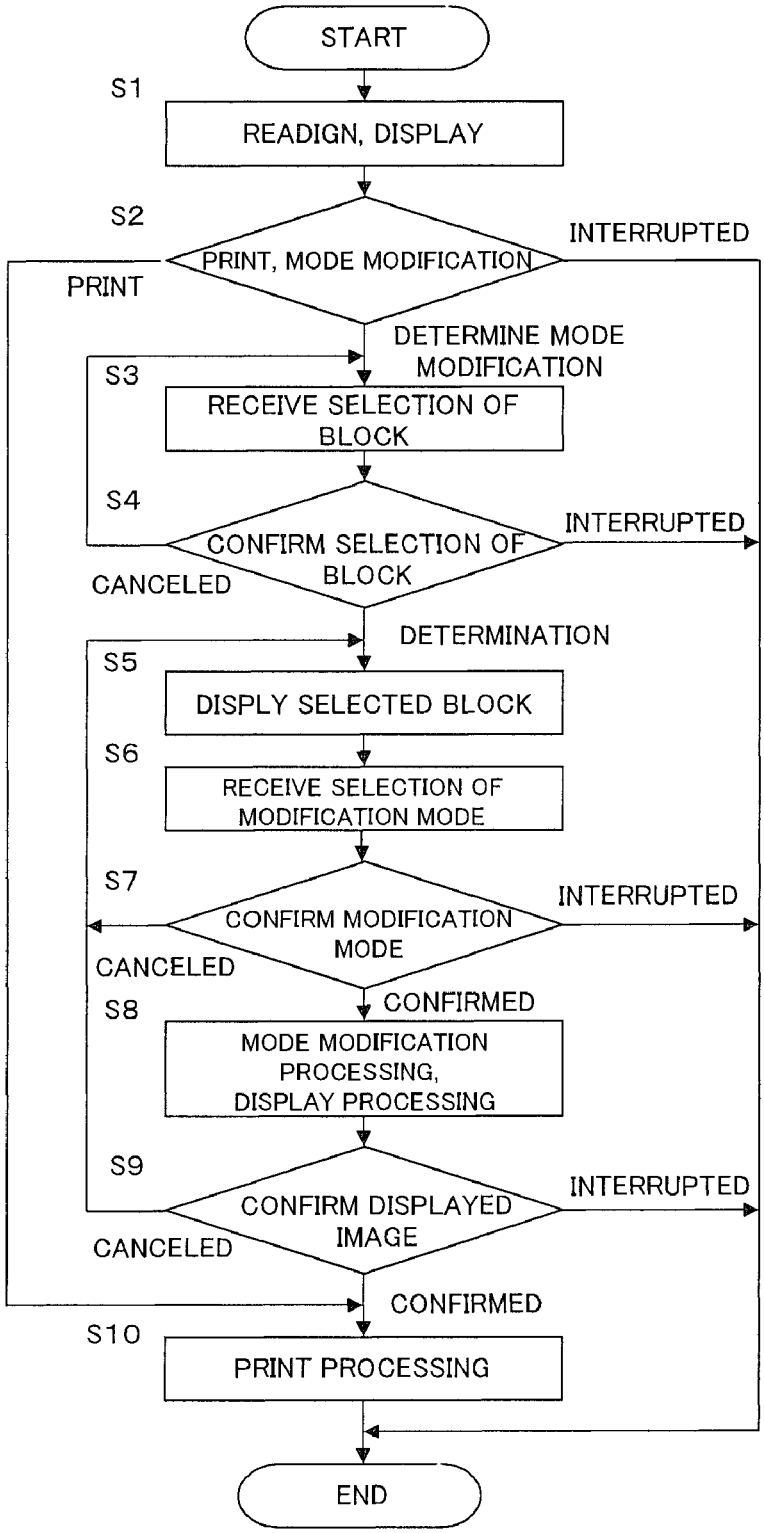
FIG. 4 is a flowchart explaining an operation of the image forming apparatus of the present invention.

As shown in FIG. 4, when a program is started, in step S1, the image reading section 3 executes reading processing of the image data from a printed manuscript, the storage section 5 executes storage processing, and the image displayer 7 executes display processing. Subsequently, in step S2, the image selector 9 receives a classification such as a print of a displayed image or modification of the image mode, and judges whether or not the reception of input shows the print or the modification of the image mode.

In step S2, when the image selector 9 receives the print of the displayed image, the controller 1 executes the processing of moving to step S10 without modifying the mode, and when the image selector 9 receives determination of the modification mode of the displayed image, the controller 1 executes the processing of moving to step S3, and when interruption is received, the processing is ended as it is.

In step S3, the image selector 9 executes the processing of receiving the selection of the block region in the image displayer 7.

In the subsequent step S4, the image selector 9 applies selection judgment processing to the block region, and when the selection shows "cancel", the processing is executed to return to step S3, and when "determination" is shown, the processing of moving to step S5 is executed, and when "interruption" is shown, the processing is ended as it is.

In step S5, the image processor 11 executes the processing of displaying in the image displayer 7 the image data corresponding to the selected block region. In step S6, the image selector 9 applies the processing of receiving the selection of the modification mode (the selection such as making the density high), to the image data of the selected block region.

In the subsequent step S7, the image selector 9 executes the processing of judging the modification mode, and when "cancel" is received, executes the processing of returning to step S5 again, and when "determination" is received, executes the processing of moving to step S8, and when "interruption" is received, the processing is ended as it is.

In step S8, the image processor 11 executes the processing of modifying the image to make the density of an image corresponding to the selected block region high, and executes the processing of displaying the modified image data. In the next step S9, the image selector 9 executes the processing of receiving an input of confirmation of the displayed mode and judges the content of this reception.

In step S9, when the input of confirmation shows the reception of "cancel", the image selector 9 executes the processing of moving to step S5, and when the reception of "determination" is shown, executes the processing of moving to step S10 and executes the processing of replacing the image data portion before modification with the modified image data, and when the reception of "interruption" is shown, the processing is ended.

In step S10, the image processor 11 and the printer 13 execute print processing, and the processing is ended.

The aforementioned operation processing is executed by the image forming program of the present invention.

Thus, the image forming apparatus according to the present invention includes the image displayer 7 that displays the image data correlated to a plurality of block regions 11 to 66; the image selector 9 that receives the selection of arbitrary block regions 14 to 36, and the selection of changing, for example, an increase of the image density of the image data corresponding to the selected block regions 14 to 36; the image processor 11 that executes the processing of changing the increase of the image density of the selected image data corresponding to the selected block region and displays this image data in the image displayer 7; and an image replacement section (image selector) 9 that replaces the image data portion before modification with the modified image data whose image density is modified when the modified image data displayed in this image displayer 7 is determined and selected.

Therefore, it becomes possible to partially display the image data in a block region unit and select such partial image data before printing, and also possible to print the image, with the density, for example, of the image corresponding to the selected block region made to be high.

Accordingly, since it is possible to modify the mode of the image data and confirm this modified image mode before printing, it becomes easy to obtain an expected print mode.

In addition, the image data after modification processing is displayed in the image displayer 7, correlated to a plurality of block regions AA to FF, so that it becomes easy to make the boundary between a partial region in the displayed image data and the outer periphery of this partial region coincide with the boundary between each of the block regions AA to FF or approach thereto.

Therefore, by touching to designate a desired block region in the block regions 11 to 66 (corresponding to the block regions AA to FF after modification), it is possible to easily designate only this image region, without requiring another input/output device such as a digitizer or a coordinate input pen, thus making it also possible to realize a simple structure.

Further, the operation section 15 is formed by the image selector 7 and the image displayer 9, thus making the structure and processing simplified.

In addition, it is possible to partially modify the image quality of only the block region selected by the image selector 9, and the image quality of an entire body of image data is not modified. Therefore, an increase in the amount of data can be suppressed. Also, a consumption amount of the toner for image transfer can be suppressed.

In addition, in the image forming apparatus according to the present invention, it is possible to perform not only the color modification such as increase or decrease of the image density executed to a partial region such as only the block region selected by the image selector 9, but also the color modification of color tone executed to the image data of the selected block region, and also the size modification such as magnification or reduction executed to the image data. In accordance with such modifications, the image selector 9 and the image processor 11 may be formed. An important point is to modify the image mode of the image data.

In addition, in the image forming apparatus according to the present invention, the selection of the image or the modification processing is not limited to once, and the display and the selection of the image data may be repeated a plurality of times.

Incidentally, in the image forming apparatus according to the present invention, the modification mode of the image data corresponding to the boundary block regions 14, 15, 16, 24, 26, 34, 35, 36 in the selected block regions can be modified to the mode between the mode of the image data corresponding to other selected block region 25 and the mode of the image data corresponding to the non-selected boundary block regions 13, 23, 33, 43, 44, 45, 46.

When the density of the boundary block regions 14 to 16, 24, 26, 34 to 36 are modified, for example, to the intermediate density, a difference between the modified image and a circumferential non-modified image can be suppressed to be small. In accordance with this structure, the image processor 11 may be formed.

Also, in the image forming apparatus according to the present invention, the modification mode of the image data is not limited to one kind, and a plurality of modification modes such as a combination of the density and the magnification (reduction) can be simultaneously selected.

Further, the image forming method according to the present invention includes an image display processing for displaying the image data correlated to a plurality of block regions; an image selection processing for selecting an arbitrary block region in the displayed block regions, and selecting the modification of the image mode of the image data corresponding to the selected block regions; the image modification processing for the processing to modify the image mode of the image data corresponding to the selected block regions to the selected image mode, and the processing to display this modified image data; the selection determination processing to select and determine the displayed modified image data; and the image replacement processing for replacing the image data portion before modification, with the image data whose image mode is modified, when the modified image data is determined by this selection determination processing, thus making it possible to exhibit an advantage similar to that of the aforementioned image forming apparatus of the present invention. Various applications can also be possible similarly to the image forming apparatus.

Meanwhile, in the image forming program according to the present invention, the image processing computer for processing to modify the image mode of the image data correlated to a plurality of block regions, is caused to execute the image display processing for displaying the image data correlated to the plurality of block regions; the image selection processing for receiving the selection of an arbitrary block region and the selection of modifying the image mode of the aforementioned image data corresponding to the selected block region; the image processing for processing to modify the image data corresponding to the selected block region, to the selected image mode and displaying this image mode; and the image replacement processing for replacing the modified image data with the image data before modification when the displayed image data is selected and determined. Thus, it is possible to obtain a similar advantage as that of the image forming apparatus of the present invention as described above, and various applications are possible similarly to the image forming apparatus.

Further, according to the present invention, in addition to the processing executed in a machine body such as a copying machine, it is also possible to arrange the aforementioned constituent elements of the present invention so as to be dispersed in the copying machine (multi function peripheral) connected to the machine body via a network.

What is claimed is:

1. An image forming apparatus, comprising:

an image displayer that displays image data correlated to a plurality of block regions;

an image selector that receives a selection of arbitrary said block region in displayed said block regions, and a selection of modifying an image mode of said image data corresponding to selected said block regions;

an image processor that applies modification processing and display processing to said image data corresponding to selected said block regions, said modification processing being the processing of modifying said image data to selected said image mode and said display processing being the processing of displaying modified image data in said image displayer; and an image replacement section that replaces image data portion before modification with modified image data, when said modified image data displayed in said image displayer is selected and determined.

2. The image forming apparatus according to claim 1, wherein said image displayer magnifies and displays selected said block region, and said image selector receives a selection of modifying said image mode of said image data corresponding to magnified and displayed said block region.

3. The image forming apparatus according to claim 1, wherein said image selector is formed so that a selection of color modification can be received as the selection of modifying said image mode, and said image processor applies processing of said color modification to said image data.

4. The image forming apparatus according to claim 1, wherein said image selector is formed so that a selection of modifying a size can be received as a selection of modifying said image mode, and said image processor applies processing of modifying said size to said image data.

5. The image forming apparatus according to claim 1, wherein based on a re-selection of said image mode by said image selector directed to displayed said modified image data, said image processor applies processing of re-modifying said modified image data to said modified image data.

6. The image forming apparatus according to claim 1, wherein said image selector also serves as said image displayer.

7. The image forming apparatus according to claim 1, wherein said image processor modifies a modification mode of said image data corresponding to a boundary block in selected said block region, to a mode between a mode of said image data corresponding to selected other said block region and a mode of said image data corresponding to non-selected said block region.

8. An image forming method, comprising:

image display processing for displaying image data correlated to a plurality of block regions;

image selection processing, executed by a controller, for selecting arbitrary said block region in displayed said block regions, and selecting a modification of an image mode of said image data corresponding to said block regions;

image modification processing for executing processing to modify said image data corresponding to selected said block region, to selected said image mode, and processing to display this modified image data;

selection determination processing for selecting and determining displayed said modified image data; and image replacement processing for replacing said image data portion before modification, with the image data whose image mode is modified, when said modified image data is determined by this selection determination processing.

9. The image forming method according to claim 8, wherein said image display processing magnifies and displays selected said block region, and said image selection processing receives a selection of modifying said image mode of said image data corresponding to magnified and displayed said block region.

10. The image forming method according to claim 8, wherein said image selection processing receives a selection of color modification as a selection of modifying said image mode, and said image processing applies processing of said color modification to said image data.

11. The image forming method according to claim 8, wherein said image selection processing receives a selection of modifying a size as a selection of modifying said image mode, and said image processing applies processing of modifying said size to said image data.

12. The image forming method according to claim 8, wherein based on a re-selection of said image mode by said image selection processing directed to displayed said modified image data, said image modification processing applies processing of re-modifying said image mode to said modified image data.

13. The image forming method according to claim 8, wherein said image processing executes processing of modifying a modification mode of said image data corresponding to a boundary block in selected said block region, to a mode between a mode of said image data corresponding to selected other said block region and a mode of said image data corresponding to non-selected said block region.

14. An image forming program embodied in a computer readable medium for causing an image processing computer for executing processing of modifying an image mode of image data correlated to a plurality of block regions, to execute:

an image display processing for displaying said image data correlated to a plurality of block regions;

an image selection processing for receiving a selection of arbitrary said block region in displayed said block region, and a selection of modifying an image mode of said image data corresponding to selected said block region;

image processing applied to said image data corresponding to selected said block region, such as processing of modifying the image data to selected said image mode and processing of displaying this modified image data; and image replacement processing for replacing image data portion before modification, with the image data whose image mode is modified, when displayed said modified image data is selected and determined.

15. The image forming program according to claim 14, wherein said image display processing magnifies and displays selected said block region, and receives a selection of modifying said image mode of said image data corresponding to magnified and displayed said block region.

16. The image forming program according to claim 14, wherein said image selection processing receives a selection of color modification as a selection of modifying said image mode, and applies processing of said color modification to said image data.

17. The image forming program according to claim 14, wherein said image selection processing receives a selection of modifying a size as a selection of modifying said image mode, and applies processing of modifying said size to said image data.

18. The image forming program according to claim 14, wherein based on a re-selection of said image mode by said image selection processing directed to displayed said modified image data, said image processing applies processing of re-modifying said image mode to said modified image data.

19. The image forming program according to claim 14, wherein said image processing executes processing of modifying a modification mode of said image data corresponding to a boundary block in selected said block region, to a mode between a mode of said image data corresponding to selected other said block region and a mode of said image data corresponding to non-selected said block region.

* * * * *